US012687322B2

(12) United States Patent
Okamoto et al.

(10) Patent No.: US 12,687,322 B2
(45) Date of Patent: Jul. 21, 2026

(54) HOT WATER SUPPLY SYSTEM

(71) Applicant: NORITZ CORPORATION, Hyogo (JP)

(72) Inventors: Shinichi Okamoto, Hyogo (JP); Atsushi Ushio, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 317 days.

(21) Appl. No.: 18/624,164

(22) Filed: Apr. 2, 2024

(65) Prior Publication Data

US 2024/0361039 A1 Oct. 31, 2024

(30) Foreign Application Priority Data

Apr. 27, 2023 (JP) ..... 2023-073103

(51) Int. Cl.
*F24H 15/414* (2022.01)
*F24H 15/238* (2022.01)

(52) U.S. Cl.
CPC ..... *F24H 15/414* (2022.01); *F24H 15/238* (2022.01)

(58) Field of Classification Search
CPC ..... F24H 15/414; F24H 15/238; F24H 15/31; F24H 15/325; F24H 15/36; F24H 15/365; F24H 9/2035; F24H 15/305; F24H 15/429; F24H 15/443; F24D 2200/043; F24D 19/1051; H04B 3/02
See application file for complete search history.

(56) References Cited

U.S. PATENT DOCUMENTS

2022/0349623 A1* 11/2022 D'Amore ..... C02F 1/004

FOREIGN PATENT DOCUMENTS

JP 2021116977 8/2021

* cited by examiner

*Primary Examiner* — Mohammad Ali
*Assistant Examiner* — Sheela Rao
(74) *Attorney, Agent, or Firm* — JCIPRNET

(57) ABSTRACT

Provided is a hot water supply system in which each of multiple hot water suppliers communicatively connected in series by a communication line includes a first communication unit for communicating with another adjacent hot water supplier on the downstream side via the communication line and a second communication unit for communicating with another adjacent hot water supplier on the upstream side. The controller of each hot water supplier executed a control processing to recognize, based on presence or absence of communication by the first communication unit and the second communication unit, its role as a leader positioned at the most upstream side of a series connection constituting a communication connection and operating to execute a supervisory control for cooperative control; a terminal follower positioned at the most downstream of the series connection constituting the communication connection; or a middle follower located between the leader and the end follower.

6 Claims, 10 Drawing Sheets

| | 100a | 100b | 100c | 100d | 100e | 100f |
|---|---|---|---|---|---|---|
| State 1 | Main 1 | Main 2 | Sub | Sub | Sub | Sub |
| State 2 | Sub | Main 1 | Main 2 | Sub | Sub | Sub |
| State 3 | Sub | Sub | Main 1 | Main 2 | Sub | Sub |
| ⋮ | | | | ⋮ | | |

HOT WATER SUPPLY SYSTEM

CROSS-REFERENCE TO RELATED APPLICATION

This application claims the priority benefits of Japanese application no. 2023-073103, filed on Apr. 27, 2023. The entity of the above-mentioned patent application is hereby incorporated by reference herein and made a part of this s specification.

BACKGROUND

Technical Field

The disclosure relates to a hot water supply system, and more particularly to a connected hot water supply system including multiple hot water suppliers connected in parallel to a hot water outlet route.

Related Art

A hot water supply system capable of handling outgoing of a large amount of hot water by including multiple hot water suppliers connected in parallel to a hot water outlet route is known.

For example, in Japanese Unexamined Patent Publication No. 2021-116977 (Patent Literature 1), it is described that a hot water supply system is configured by cooperative control of multiple hot water suppliers communicatively connected in a string (daisy-chained).

In the hot water supply system of Patent Literature 1, by installing a program for a supervisory control function of cooperative control in a controller of each hot water supplier, it is unnecessary to arrange a separate controller for supervisory control. That is, cooperative control is realized by the controller of one of the multiple hot water suppliers operating as a master controller by executing the program for the supervisory control function.

In Patent Literature 1, in a case where a communication failure occurs in a daisy-chained communication connection, a group of hot water suppliers may lose communication with the current master controller. For this reason, a control processing for automatically deciding a new master controller in the group of hot water suppliers is executed in response to the detection of a communication interruption, and it is possible to avoid a decrease in the number of hot water suppliers compatible with cooperative control and prevent a decrease in the hot water supply capacity of the entire hot water supply system.

CITATION LIST

Patent Literature

[Patent Literature 1] JP2021-116977A

However, in the hot water supply system of Patent Literature 1, when a communication interruption occurs, the hot water supplier that is no longer communicatively connected to the master controller activates a program for control function in a predetermined order, and a new master controller is automatically decided. For this reason, when arranging a hot water supply system, it is necessary to input information that distinguishes between multiple hot water suppliers in order to recognize the predetermined order, so there is concern that the setup work by workers will become complicated.

The disclosure has been made to solve these problems, and the purpose of the disclosure is to automatically decide the role allocation of cooperative control in a hot water supply system in which multiple hot water suppliers are communicatively connected in a daisy-chained manner, without inputting information for distinguishing between the hot water suppliers to the multiple hot water suppliers.

SUMMARY

In one aspect of the disclosure, a hot water supply system is provided. A hot water supply system includes multiple hot water suppliers connected in parallel to a common hot water outlet route. Each of the multiple hot water suppliers includes a first communication unit and a second communication unit connectable to different communication lines, and a controller that controls an operating of the hot water supplier. The controller of each of the hot water suppliers is configured in advance to have a supervisory control function for cooperatively operating a group of hot water suppliers communicatively connected in series via communication lines. Between adjacent hot water suppliers in a series connection constituting the communication connection, the first communication unit of a hot water supplier on an upstream side, which is one predetermined end side of the series connection, and the second communication unit of a hot water supplier on a downstream side, which is the other end side of the series connection, in the group of hot water suppliers are communicatively connected sequentially. Each of the controllers executes a first control processing and a second control processing. In the first control processing, each controller recognizes, based on presence or absence of communication between the first communication unit and the second communication unit, whether the controller is a leader controller installed on a leader hot water supplier positioned at a most upstream of the series connection in the group of hot water suppliers and operating to execute the supervisory control; an end follower controller installed on an end follower hot water supplier positioned at a most downstream of the series connection in the group of hot water suppliers; or a middle follower controller installed on a hot water supplier communicatively connected between the leader hot water supplier and the end follower hot water supplier. In the second control processing, each of the controllers operates such that data initialized by the leader controller is transmitted to the end follower controller while being changed according to a predetermined rule by each of the middle follower controllers, and the data is further changed by the end follower controller according to the rule is transferred, with content unchanged, to the leader controller by each of the middle follower controllers.

DESCRIPTION OF THE EMBODIMENTS

Figure 1:
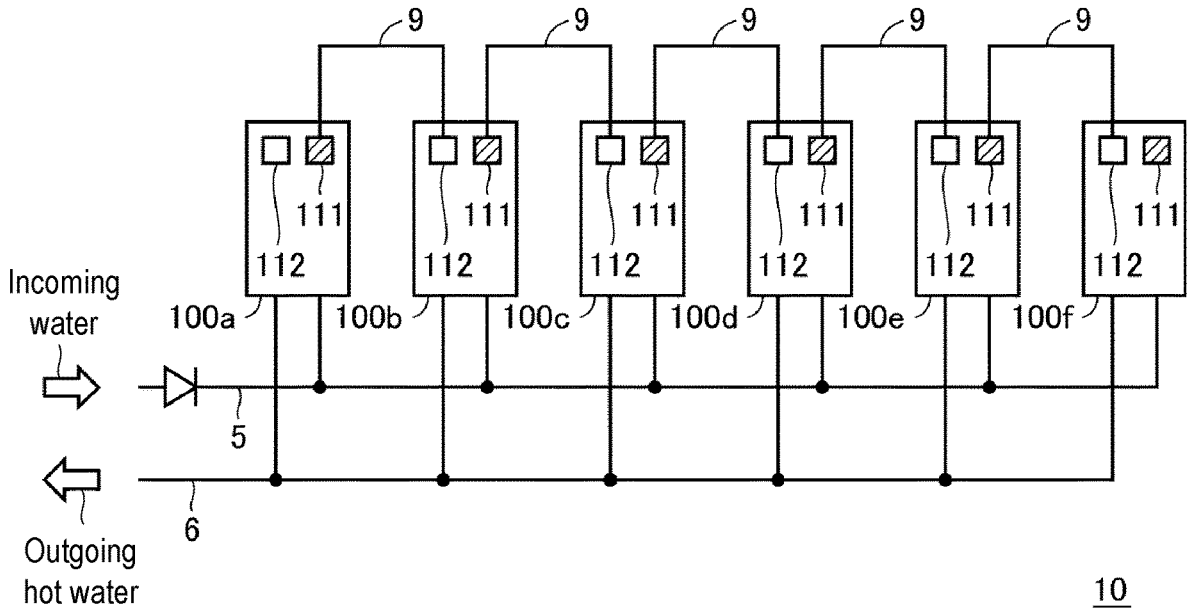
FIG. 1 is a schematic diagram illustrating configuration of a hot water supply system according to an embodiment.

According to the disclosure, by having the controller of each hot water supplier execute the first and second control processing, role allocation are automatically decided for cooperative control without inputting information for distinguishing between hot water suppliers to multiple hot water suppliers.

Embodiments of the disclosure will be described in detail below with reference to the drawings. Moreover, hereinafter, the same or corresponding parts in the drawings will be denoted by the same reference numerals, and the description thereof will not be repeated in principle.

(Configuration of Hot Water Supply System)

FIG. 1 is a schematic diagram illustrating configuration of a hot water supply system 10 according to the embodiment.

Referring to FIG. 1, the hot water supply system 10 according to the embodiment includes a water inlet route 5, a hot water outlet route 6, and multiple hot water suppliers 100*a* to 100*f* connected in parallel to the hot water outlet route 6.

Hereinafter, in the embodiment, the hot water supply system 10 is composed of six hot water suppliers 100*a* to 100*f*, but the number of hot water suppliers 100 connected in parallel that constitute the hot water supply system 10 is arbitrary. Further, the following descriptions that distinguish the six hot water suppliers are to indicate each element with subscripts a to f; whereas the descriptions common to the six hot water suppliers are to indicate each element without the subscripts a to f.

In the example of FIG. 1, the hot water suppliers 100*a* to 100*f* are also connected in parallel with the water inlet route 5, but in the hot water supply system 10, the water inlet route 5 may not need to be completely common among the hot water suppliers 100*a* to 100*f*.

Each of the hot water suppliers 100*a* to 100*f* includes a first communication unit 111 and a second communication unit 112 that may be connected to different communication lines 9. The hot water suppliers 100*a* to 100*f* are communicatively connected in series in a daisy-chained manner by sequentially connecting the first communication unit 111 of one hot water supplier and the second communication unit 112 of another hot water supplier with the communication lines 9 between adjacent hot water suppliers. The first communication unit 111 and the second communication unit 112 transmit and receive data by, for example, full-duplex serial communication. That is, in a series connection constituting a communication connection, one predetermined end side is defined as the "upstream side," and the other end side is predefined as the "downstream side."

Moreover, in FIG. 1, for convenience of notation, the communication lines 9 is shown on the upper side of the hot water suppliers 100*a* to 100*f*, in reality, the communication connection may also be established by connecting communication terminals (not shown) provided at the lower portions of the hot water suppliers 100*a* to 100*f* with the communication lines 9. Further, in FIG. 1, multiple communication lines 9 are indicated by the same reference numeral, but each communication line 9 connects one hot water supplier 100 to another hot water supplier 100 on a one-to-one basis, and in the embodiment, it is confirmatively described that no same communication line connecting multiple hot water suppliers 100 is configured.

In the following, with respect to the hot water suppliers 100*a* to 100*f* arranged in parallel, the hot water supplier 100*a* side (left side in the drawing) is the upstream side, and the hot water supplier 100*f* side (the right side in the drawing) is the downstream side. The communication connection will also be described assuming that a communication connection in series (daisy chained) is formed such that the hot water supplier 100*a* is the most upstream and the hot water supplier 100*f* is the most downstream by connecting adjacent hot water suppliers in a natural manner with each communication line 9.

Figure 2:
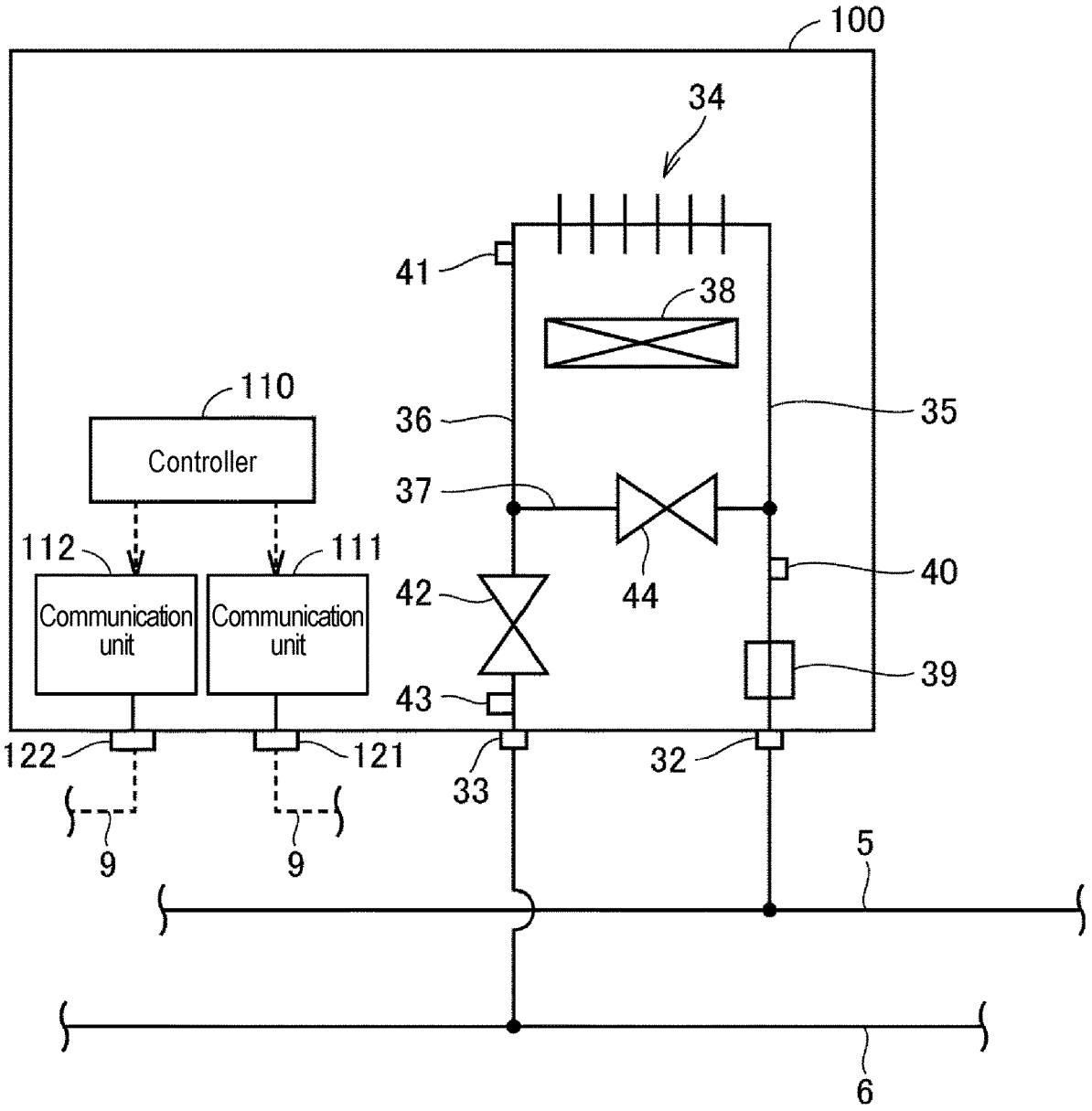
FIG. 2 is a schematic diagram illustrating a configuration example of each hot water supplier shown in FIG. 1.

FIG. 2 shows a configuration example of the hot water supplier 100.

Referring to FIG. 2, hot water supplier 100 includes a water inlet port 32 connected to the water inlet route 5; a hot water outlet port 33 connected to the hot water outlet route 6, a heat exchanger 34, a water inlet passage 35, a hot water outlet passage 36, a bypass passage 37, a combustion burner 38, a flow rate adjustment valve 42, a controller 110, the first communication unit 111, the second communication unit 112, a first communication connector 121, and a second communication connector 122.

The water inlet passage 35 guides low-temperature water from the water inlet port 32 to the heat exchanger 34. The combustion burner 38 generates combustion heat of fuel (typically gas) when operating (combustion is ON). The heat exchanger 34 uses the amount of heat generated by the combustion burner 38 to heat the low-temperature water flowing through the heat exchanger 34. The hot water outlet passage 36 guides the heated high-temperature water that has passed through the heat exchanger 34 to the hot water outlet port 33. The combustion burner 38 and the heat exchanger 34 constitute a "heating mechanism."

The bypass passage 37 bypasses the heat exchanger 34 and guides the low-temperature water directly to the hot water outlet passage 36. The hot water outlet port 33 outputs hot water at an appropriate temperature, which is a mixture of the high-temperature water from the heat exchanger 34 and the low-temperature water that has passed through the bypass passage 37. A bypass flow rate adjustment valve 44 is inserted and connected to the bypass passage 37, and by adjusting the opening degree of the bypass flow rate adjustment valve 44, the mixing ratio of high-temperature water and low-temperature water in the hot water outlet passage 36 may be controlled.

The water inlet passage 35 is provided with a flow rate sensor 39 for detecting the incoming water flow rate in response to a hot water supply request (for example, opening of a hot water tap (not shown)), and an incoming water temperature sensor 40 for detecting the incoming water temperature. Further, the hot water outlet passage 36 is provided with a can body temperature sensor 41 and an outgoing hot water temperature sensor 43. The can body temperature sensor 41 is disposed on the upstream side (on the heat exchanger 34 side) of a merging position with the bypass passage 37 and detects the temperature of the high-temperature water output from the heat exchanger 34. The outgoing hot water temperature sensor 43 is disposed on the downstream side (on the hot water outlet port 33 side) of the merging position, and detects the temperature of hot water outgoing from the hot water outlet port 33.

The flow rate adjustment valve 42 for adjusting the flow rate of outgoing hot water is inserted and connected on the downstream side of a merging position of the hot water outlet passage 36. The flow rate adjustment valve 42 has a function of controlling the opening degree to be fully closed (flow rate=0). That is, the flow rate adjustment valve 42 may adjust the hot water supply flow rate of the hot water supplier 100 from Q=0 to Q=Qmax (flow rate at maximum opening degree).

The controller 110 is typically configured by a microcomputer. The controller 110 controls each element of hot water supplier 100 using the detected values of each sensor described above. In the example of FIG. 2, the controller 110 may control the opening degrees of the flow rate adjustment valve 42 and the bypass flow rate adjustment valve 44, as well as the combustion ON/OFF of the combustion burner 38 and the amount of heat generated.

When the controller 110 detects that a passing flow rate through the "heating mechanism" has reached or exceeded a predetermined minimum operating flow rate (MOQ) based on the detected value of the flow rate sensor 39 (hereinafter also referred to as "water flow ON"), it starts hot water supply by starting combustion (i.e. operation of the heating mechanism) in the combustion burner 38. At this time, the passing flow rate of the heating mechanism may be calculated using the detected value of the flow rate sensor 39 (incoming water flow rate, i.e. hot water supply flow rate) and the mixing ratio based on the opening degree of the bypass flow rate adjustment valve 44. Thus, when the flow rate adjustment valve 42 is fully closed, the hot water supplier 100 does not execute hot water supply because the incoming water flow rate does not exceed the MOQ.

Moreover, the flow rate sensor 39 may also be arranged on the downstream side of a connection point with the bypass passage 37. In this case, the detected value of the flow rate sensor 39 may be used, without change, to detect "water flow ON", and the above-mentioned mixing ratio may further be used to calculate the incoming water flow rate toward the hot water supplier 100, that is, the flow rate of hot water supply.

During hot water supply, the controller 110 executes hot water supply temperature control. For example, based on the detected values of the incoming water flow rate (flow rate sensor 39), incoming water temperature (incoming water temperature sensor 40), and outgoing hot water temperature (outgoing hot water temperature sensor 43), the amount of heat generated by the combustion burner 38, which depends on the amount of supplied fuel, and the mixing ratio, which depends on the opening degree of the bypass flow rate adjustment valve 44, are controlled such that the detected value of the outgoing hot water temperature matches of the outgoing hot water setting temperature.

Further, in the hot water supplier 100 configuring the hot water supply system 10, the controller 110 controls the flow rate using the flow rate adjustment valve 42. Specifically, each hot water supplier 100 is set to either standby mode or water flow mode by a control command from a leader controller, which will be described later, as part of cooperative control.

In the hot water supplier 100 in the water flow mode, the flow rate adjustment valve 42 is opened and basically set to the maximum opening degree corresponding to the maximum flow rate Qmax described above. On the other hand, in the hot water supplier 100 in standby mode, the flow rate adjustment valve 42 is controlled to be fully closed.

The first communication unit 111 of each hot water supplier 100 transmits and receives data to and from the second communication unit 112 of another adjacent hot water supplier via the communication line 9 connected to the first communication connector 121. Similarly, the second communication unit 112 transmits and receives data to and from the first communication unit 111 of yet another adjacent hot water supplier via the communication line 9 connected to the second communication connector 122.

In each hot water supplier 100, the first communication unit 111, the first communication connector 121, the second communication unit 112, and the second communication connector 122 may be installed, for example, on a printed circuit board on which the controller 110 is mounted.

Further, in FIG. 2, the controller 110, the first communication unit 111, and the second communication unit 112 are shown as separate elements, but in a case where the main part of the controller 110 is configured by a microcomputer, some functions of each of the first communication unit 111 and the second communication unit 112 may be realized by the microcomputer.

(Description of Cooperative Control)

Next, cooperative control in the hot water supply system 10 will be described with reference to FIGS. 3 and 4.

Figure 3:
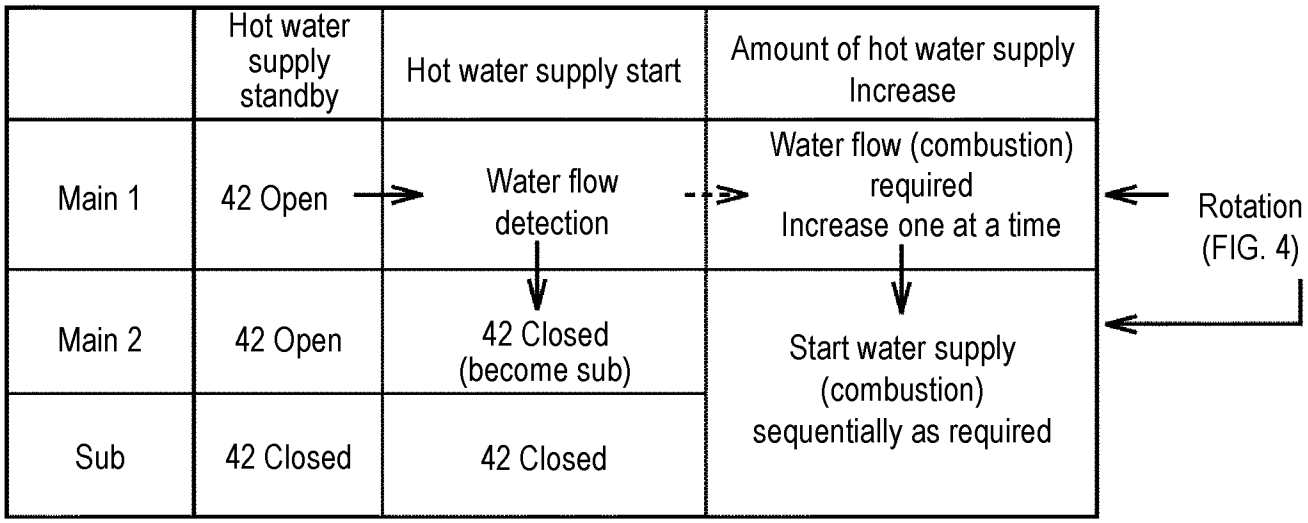
FIG. 3 is a first diagram illustrating cooperative control in the hot water supply system shown in FIG. 1.

As shown in FIG. 3, cooperative control is executed by classifying the hot water suppliers 100*a* to 100*f* into one "main 1 hot water supplier", one or more "main 2 hot water suppliers", and other "sub hot water suppliers." When the hot water supply system 10 is on standby for hot water supply, each of the sub hot water suppliers is set to standby mode and the flow rate adjustment valve 42 (FIG. 2) is closed. On the other hand, each of the main 1 hot water supplier and the main 2 hot water supplier is set to water flow mode, and the flow rate adjustment valve 42 (FIG. 2) is opened.

When the hot water supply system 10 starts supplying hot water, water flow is not detected in each of the sub hot water suppliers in which the flow rate adjustment valve 42 is closed, and combustion is not started. On the other hand, in each of the main 1 hot water supplier and the main 2 hot water supplier in which the flow rate adjustment valve 42 is open, the flow rate sensor 39 detects water flow reaching or exceeding the MOQ.

When the main 1 hot water supplier starts combustion in response to detection of water flow, hot water supply to the hot water outlet passage 36 is started. Further, when the main 1 hot water supplier starts supplying hot water, it instructs the main 2 hot water supplier to convert to standby mode, that is, to close the flow rate adjustment valve 42. As a result, hot water supply may be started with the hot water supply capacity of one supplier (main 1 hot water supplier), compared to the case where flow rate adjustment valves 42 of all the hot water suppliers are opened during standby for hot water supply, the lower limit range of the flow rate capable of hot water supply may be expanded.

After that, if the hot water supply flow rate of the main 1 hot water supplier (the flow rate detected by the flow rate sensor 39 when the combustion is on) exceeds a predetermined first reference flow rate, a request to convert to the water flow mode is generated for the main 2 hot water supplier. When the flow rate adjustment valve 42 of the main 2 hot water supplier is opened, hot water is also supplied from the main 2 hot water supplier in response to the water flow being detected by the flow rate sensor 39, and hot water supply of the two hot water suppliers starts. Since the hot water suppliers 100*a* to 100*f* are connected in parallel, as long as the opening degrees of the flow rate adjustment valves 42 are the same, the flow rates (hot water supply flow rate) in the main 1 hot water supplier and the main 2 hot water supplier in this state are the same.

Thus, the main 2 hot water supplier is positioned as a backup for water flow detection. That is, upon detection of water flow ON, if the main 2 hot water supplier detects an abnormality of the main 1 hot water supplier if it does not receive a command from the main 1 hot water supplier to convert to standby mode after a certain period of time. In this case, the main 2 hot water supplier starts combustion in response to the detection of the abnormality, thereby starting to supply hot water to the hot water outlet passage 36. Further, the abnormality in the main 1 hot water supplier is transmitted to a leader controller (to be described later) that supervises cooperative control.

Moreover, in a case where two or more hot water suppliers in the hot water supply system 10 are performing hot water supply operation, the last hot water supplier that starts the hot water supply operation among the hot water suppliers performing the hot water supply operation operates to supply hot water as "for capacity adjustment" in which the hot water supply flow rate changes with the opening degree control of the flow control valve 42. On the other hand, the remaining hot water suppliers executes the hot water supply operation as "for capacity fix" in which the opening degree of the flow rate adjustment valve 42 is fixed such that the flow rate of hot water supply is fixed. In the hot water suppliers that operates to supply hot water supply for capacity adjustment, if the hot water supply flow rate exceeds the first reference flow rate, the hot water supplier becomes a hot water supplier for capacity fix, and one of the hot water suppliers in standby starts hot water supply operation as a new one for capacity adjustment. For example, the first reference flow rate is equivalent to the hot water supply flow rate by a hot water supplier for capacity fix. Thus, as an example, cooperative control of the multiple hot water suppliers 100*a* to 100*f* in response to an increase in hot water supply flow rate is realized by converting the hot water suppliers one by one from standby mode to water flow mode (for capacity adjustment) toward the downstream side.

Moreover, in the hot water suppliers that are operating to supply hot water for capacity adjustment, if the hot water supply flow rate falls below a second reference flow rate that is set lower than the first reference flow rate, the hot water supplier stops supplying hot water and converts to standby mode, and one of the hot water suppliers that had been operating at fixed capacity until then starts to perform hot water supply operation newly as a hot water supplier for capacity adjustment. Thus, as an example, cooperative control of the multiple hot water suppliers 100*a* to 100*f* in response to a decrease in the hot water supply flow rate is realized by converting the hot water suppliers one by one from the water flow mode (for capacity adjustment) to the standby mode toward the upstream side. Moreover, in the main 1 hot water supplier and the main 2 hot water supplier, even if the flow rate of the heating mechanism falls below the MOQ and water flow OFF is detected, combustion is turned off while the flow rate adjustment valve 42 is kept open.

According to the above cooperative control, during hot water supply operation, the main 1 hot water supplier supplies hot water preferentially, and then the main 2 hot water supplier preferentially supplies hot water. Thus, if the designation of the operation (combustion) start order corresponding to the increase in hot water supply flow rate as described in FIG. 3 is unchanged, there is a concern that the operating time (specifically, the combustion time) of some of the hot water suppliers 100*a* to 100*f* is prolonged, which may easily cause malfunction.

Figures 4, 5:
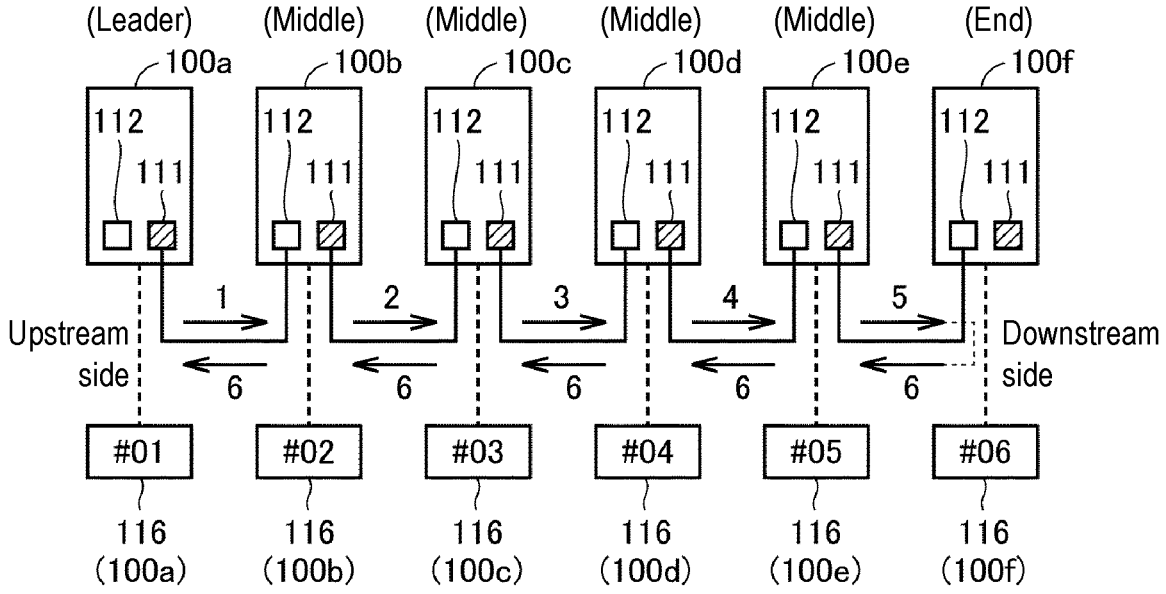
FIG. 4 is a second diagram illustrating cooperative control in the hot water supply system shown in FIG. 1.
FIG. 5 is a conceptual diagram illustrating a decision scheme for role allocation of cooperative control by the hot water supply system according to an embodiment.

Thus, a rotation shown in FIG. 4 is executed.

As shown in FIG. 4, in state 1, the hot water supplier 100*a* is designated as the main 1 hot water supplier, the hot water supplier 100*b* as the main 2 hot water supplier, and hot water suppliers 100*c* to 100*f* are designated as the sub hot water suppliers. Each of the hot water suppliers 100*a* to 100*f* sequentially calculates a cumulative value of their respective operating time (combustion time). In state 1, when the operating time (cumulative value) of the hot water supplier 100*a* reaches a predetermined time reference value, a rotation for transition from state 1 to state 2 is performed. In state 2, the designations of the main 1 hot water supplier and the main 2 hot water supplier are shifted one by one from the upstream side to the downstream side from state 1.

As a result, the hot water supplier 100*b* is designated as the main 1 hot water supplier, the hot water supplier 100*c* as the main 2 hot water supplier, and the hot water suppliers 100*d* to 100*f* and 100*a* are designated as the sub hot water suppliers. The hot water supplier 100*a* may be designated as the hot water supplier that starts supplying hot water the latest among the sub hot water suppliers. At this stage, the operating time (cumulative value) of the hot water supplier 100*a*, which is compared with the time reference value, may be cleared.

In state 2, when the operating time (cumulative value) of the hot water supplier 100*b* reaches a predetermined time reference value, a rotation for transition from state 2 to state 3 is performed. In state 3, the designations of the main 1 hot water supplier and the main 2 hot water supplier are shifted one by one from the upstream side to the downstream side from state 2.

As a result, the hot water supplier 100*c* is designated as the main 1 hot water supplier, the hot water supplier 100*d* as the main 2 hot water supplier, and the hot water suppliers 100*e* to 100*f*, 100*a*, and 100*b* are designated as the sub hot water suppliers. The hot water supplier 100*b* is treated in the same way as the hot water supplier 100*a* during the transition from state 1 to state 2.

After that, every time the operating time (cumulative value) of the hot water supplier designated as the main 1 hot water supplier reaches the time reference value, a rotation is executed in which the designations of the main 1 hot water supplier and the main 2 hot water supplier are shifted one by one from the upstream side to the downstream side. In a case where the hot water supplier 100*f* on the most downstream side is designated as the main 1 hot water supplier, the hot water supplier 100*a* on the most upstream side is designated as the main 2 hot water supplier, and after rotation is executed from this state, state 1 is formed again.

(Decision of Role Allocation of Cooperative Control)

The supervisory function for cooperative control described in FIGS. 3 and 4, particularly the function of designating the main 1 hot water supplier, the main 2 hot water supplier, and the sub hot water suppliers, is achieved by: one controller 110 of the hot water suppliers 100*a* to 100*f* operates as a "leader controller" that executes an supervisory function program to realize the supervisory function, which is equivalent to the master controller in the Patent Literature 1.

The controller 110 of each of the hot water suppliers 100*a* to 100*f* also stores programs for operating as the main 1 hot water supplier, the main 2 hot water supplier, and the sub hot water suppliers described in FIG. 3, respectively. Similarly, during execution of hot water supply operation, programs for operating as "for capacity adjustment" and "for capacity fix" are also stored in advance in the controller 110 of each of the hot water suppliers 100*a* to 100*f*, respectively. Thus, by selectively executing processing by these programs according to designations from the leader controller, each of the hot water suppliers 100*a* to 100*f* may execute any of the roles of the main 1 hot water supplier, the main 2 hot water supplier, and the sub hot water suppliers.

In the hot water supply system according to the embodiment, by storing the supervisory function program in the controller 110 of each of the hot water suppliers 100*a* to 100*f* and selectively performing the execution (activation), each controller 110 of the hot water suppliers 100*a* to 100*f* may operate as a leader controller. As a result, as in Patent Literature 1, cooperative control of the hot water suppliers 100*a* to 100*f* may be performed without arranging a higher-level supervisory controller.

With this configuration, the controller that executes the above-mentioned supervisory function program actually operates as a leader controller, and a controller that has not previously operate as a leader controller may newly operate as a leader controller by executing the supervisory function program.

In the hot water supply system according to the embodiment, through the following control processing, accompanied with automatic judgement of whether or not the controller of each hot water supplier operates as a leader controller, role allocation of cooperative control is executed.

FIG. 5 shows a conceptual diagram illustrating a decision scheme for role allocation of cooperative control by the hot water supply system according to the embodiment.

As shown in FIG. 5, the hot water suppliers 100*a* to 100*f* are communicatively connected in a daisy-chained manner by connecting the first communication unit 111 and the second communication unit 112 of adjacent hot water suppliers with the communication lines 9. At this time, the first communication unit 111 of the hot water supplier 100*a* on the most upstream side communicates with the second communication unit 112 of the adjacent hot water supplier 100*b*, while no communication is performed by the second communication unit 112.

On the other hand, the second communication unit 112 of hot water supplier 100*f* on the most downstream side communicates with the first communication unit 111 of the adjacent hot water supplier 100*e*, while no communication is performed by the first communication unit 111. Further, each of the other middle hot water suppliers 100*b* to 100*e* communicates with the second communication unit 112 of the adjacent (downstream side) hot water supplier 100 by the first communication unit 111 and communicates with the first communication unit 111 of the adjacent (upstream side) hot water supplier 100 by the second communication unit 112.

According to the combination of states of communication between the first communication unit 111 and the second communication unit 112 between such hot water suppliers, in the hot water supply system of the embodiment, it is decided which one of the roles is allocated for the multiple hot water suppliers: a "leader hot water supplier" including the above-mentioned leader controller, an "end follower hot water supplier" located on the opposite side of the leader hot water supplier in the daisy-chained connection, or other "middle follower hot water suppliers".

For example, a hot water supplier (the hot water supplier 100*a* in FIG. 5) in which the first communication unit 111 is performing communication but the second communication unit 112 does not execute communication is the "leader hot water supplier." Further, a hot water supplier (hot water supplier 100*f* in FIG. 5) in which the second communication unit 112 is performing communication while the first communication unit 111 does not execute communication is an "end follower hot water supplier", and the hot water suppliers (hot water suppliers 100*b* to 100*e* in FIG. 5) in which both the first communication unit 111 and the second communication unit 112 are executing communication are "middle follower hot water suppliers." That is, the hot water supplier at one end of the daisy-chained connection is the "leader hot water supplier," while the hot water supplier at the other end is the "end follower hot water supplier," and the hot water supplier communicatively connected between the two is the "middle follower hot water supplier."

The hot water supplier 100*a*, which is the leader hot water supplier, initializes an address counter value ADR (for example, ADR=1) and transmits the initialized address counter value ADR to the adjacent hot water supplier 100*b* on the downstream side via the first communication unit 111. The hot water supplier 100*a* recognizes address of its own device (for example, #01) based on the transmitted address counter value ADR (transmission ADR).

The middle follower hot water supplier 100*b*, upon receiving the address counter value ADR transmitted from the adjacent hot water supplier 100*a* on the upstream side through the second communication unit 112, adds a specified value to the received address counter value (reception ADR) so as to calculate the transmission ADR to the adjacent hot water supplier 100*c* on the downstream side. For example, the transmission ADR is calculated as 1+1=2. The hot water supplier 100*b* recognizes address of its own device (for example, #02) based on the transmission ADR. Further, the transmission ADR is transmitted by the first communication unit 111 to the adjacent hot water supplier 100*c* on the downstream side.

The other middle follower hot water suppliers 100*c* to 100*e* also operate in the same manner as the hot water supplier 100*b* described above. As a result, the hot water suppliers 100*c* to 100*e* recognize addresses of their own devices (for example, hot water supplier 100*c*=#03, the hot water supplier 100*d*-#04, the hot water supplier 100*e*=#05) based on the transmission ADR. Then, the transmission ADR (=5) is transmitted from the first communication unit 111 of the hot water supplier 100*e* to the second communication unit 112 of the hot water supplier 100*f*, which is the end follower hot water supplier.

The hot water supplier 100*f*, which is the end follower, adds a specified value to the address counter value (reception ADR) received from the hot water supplier 100*e* so as to calculate the transmission ADR. The hot water supplier

100*f* recognizes address of its own device (for example, #06) based on this transmission ADR. The value of transmission ADR in the end follower (for example, "6") may be understood as indicating a total number, indicating the number of hot water suppliers communicatively connected in a daisy-chained manner, that is, the number of hot water suppliers executing cooperative control.

The second communication unit 112 of the hot water supplier 100*f*, which is the end follower, transmits the transmission ADR to the first communication unit 111 of the adjacent hot water supplier 100*e* on the upstream side in order to send the transmission ADR back to the leader hot water supplier. Each of the hot water suppliers 100*b* to 100*e*, which are middle followers, upon receiving the transmission ADR transmitted from the second communication unit 112 of the adjacent hot water supplier on the downstream side, transmits the value of the transmission ADR, without change, sequentially to the first communication unit 111 of the adjacent hot water supplier on the upstream side.

As a result, the first communication unit 111 of the hot water supplier 100*a*, which is the leader hot water supplier, receives the transmission ADR in the end follower hot water supplier (hot water supplier 100*f*) transferred by the hot water suppliers 100*b* to 100*e* (middle follower hot water suppliers). Thereby, the leader hot water supplier may obtain the above-mentioned total number.

Next, a control processing in each hot water supplier for automatically executing the decision scheme of role allocation of cooperative control described in FIG. 5 will be described.

Figure 6:
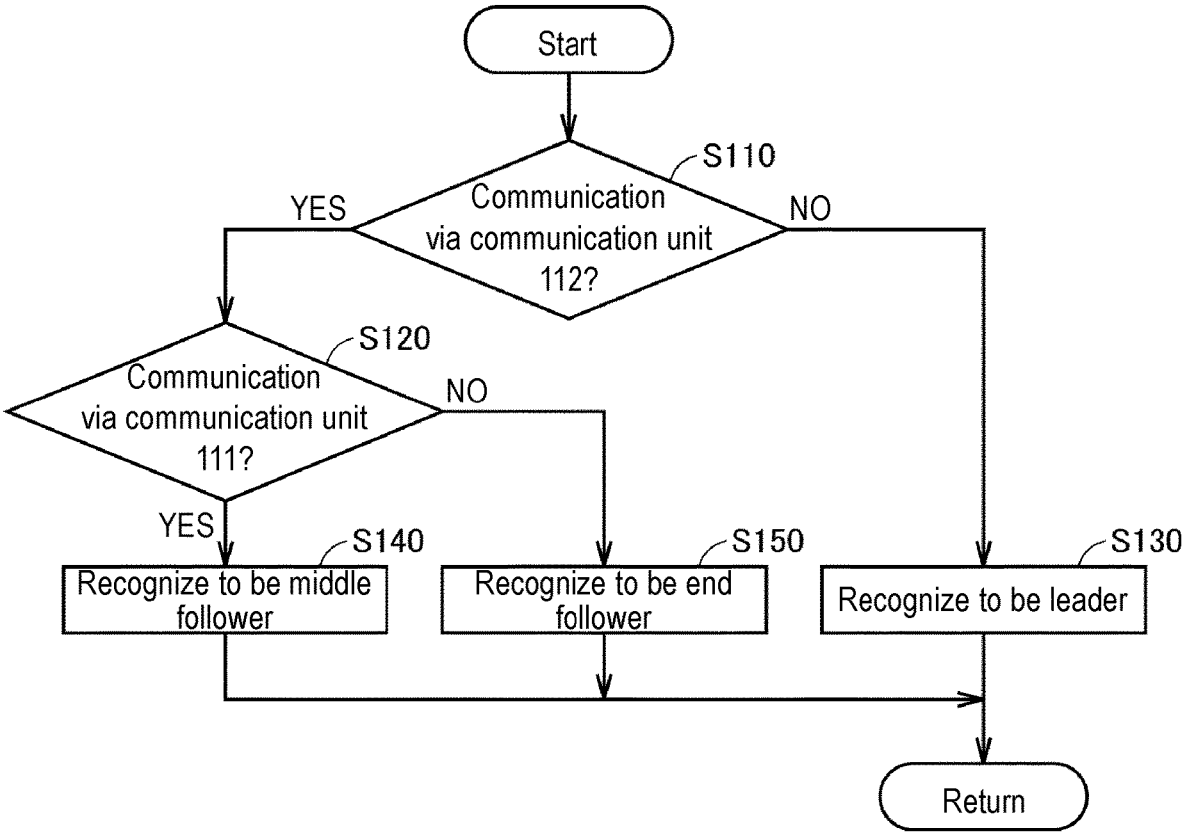
FIG. 6 is a flowchart illustrating control processing by a controller of each hot water supplier to execute the decision scheme for role allocation of cooperative control shown in FIG. 5.

FIG. 6 shows the processing executed by the controller of each hot water supplier. The control processing shown in FIG. 6 is repeatedly executed by each controller 110 of the hot water suppliers 100*a* to 100*f* while the hot water supply system 10 is in operation.

As shown in FIG. 6, the controller 110 determines whether or not communication is being performed in the second communication unit 112 by step S110 (hereinafter simply referred to as "S"). In a case where no communication is being performed in the second communication unit 112 (when the determination in S110 is NO), the controller 110 recognizes in S130 that its own device is the "leader hot water supplier".

On the other hand, in a case where communication is being performed in the second communication unit 112 (when the determination in S110 is YES), the controller 110 further determines in S120 whether or not communication is being performed in the first communication unit 111. If communication is being performed in the first communication unit 111 (when the determination in S120 is YES), the controller 110 recognizes in S140 that its own device is a "middle follower hot water supplier".

Further, in a case where no communication is being performed in the first communication unit 111 (when the determination in S120 is NO), the controller 110 recognizes in S150 that its own device is an "end follower hot water supplier".

If the control processing according to the flowchart of FIG. 6 is applied to the configuration example of FIG. 5, the determination in S110 is NO, so the hot water supplier 100*a* is recognized as the "leader hot water supplier" (S130). Moreover, the determination in S110 is YES and the determination in S120 is NO, so the hot water supplier 100*f* is recognized as an "end follower hot water supplier" (S150). Similarly, the determinations in S110 and S120 are YES, so each of the hot water suppliers 100*b* to 100*e* is recognized as a "middle follower hot water supplier" (S140). By periodically activating the processing shown in FIG. 6, the hot water suppliers 100*a* to 100*f* which are communicatively connected in a daisy-chained manner and communicate with each other may each automatically decide its own device as operating which one of: a "leader hot water supplier", a "middle follower hot water supplier", and "end follower hot water supplier", that is, decide the role allocation in cooperative control.

Figure 7:
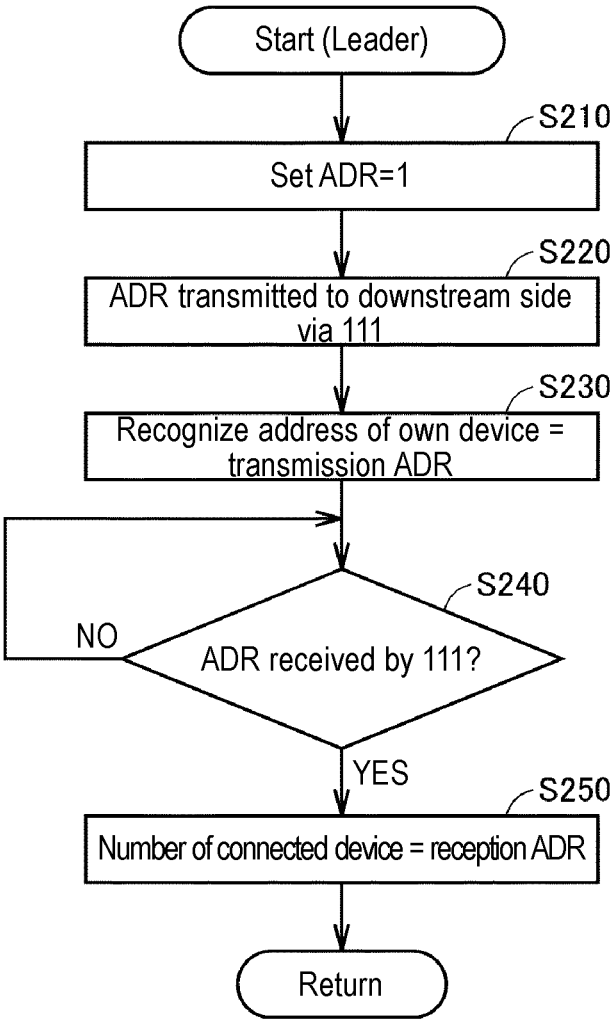
FIG. 7 is a flowchart illustrating control processing by a controller of a leader hot water supplier.
Figure 8:
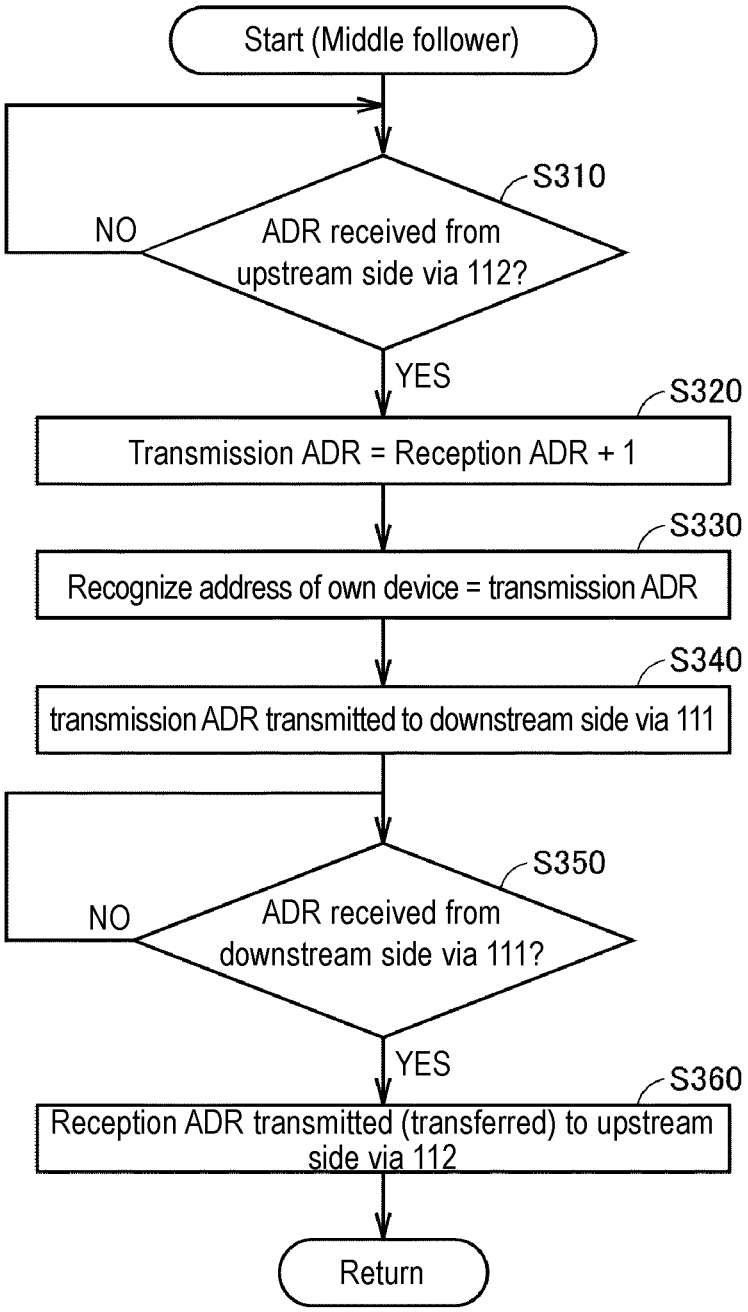
FIG. 8 is a flowchart illustrating control processing by a controller of a middle follower hot water supplier.
Figure 9:
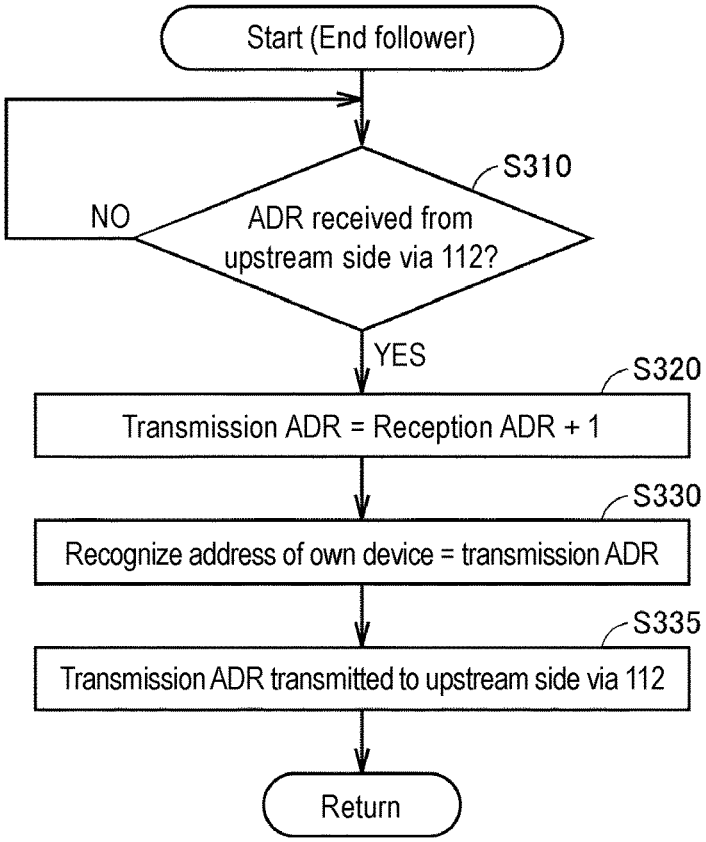
FIG. 9 is a flowchart illustrating control processing by a controller of an end follower hot water supplier.

FIGS. 7 to 9 show flowcharts illustrating control processing by each of the leader hot water supplier, middle follower hot water suppliers, and end follower hot water supplier.

FIG. 7 shows a flowchart illustrating control processing by the controller of the leader hot water supplier. The control processing shown in FIG. 7 is executed after S130, for example, by the controller of the hot water supplier that has recognized in S130 that itself is the leader hot water supplier.

As shown in FIG. 7, the controller 110 of the leader hot water supplier, upon setting the address counter value ADR to the initial value "1" in S210, transmits the address counter value ADR by the first communication unit 111 to the adjacent hot water supplier on the downstream side in S220. In the example of FIG. 5, the address counter value ADR (ADR=1) is transmitted from the hot water supplier 100*a* to the hot water supplier 100*b* in S220.

Further, in S230, the controller 110 of the leader hot water supplier recognizes the address counter value ADR (transmission ADR) transmitted in S220 as address of its own device. That is, the address of the leader hot water supplier becomes "#01".

The controller 110 of the leader hot water supplier determines in S240 whether or not the first communication unit 111 has received the address counter value ADR from the adjacent hot water supplier on the downstream side, if received (when the determination in S240 is YES), the received address counter value ADR (reception ADR) is recognized as the number of connected suppliers in the daisy-chained communication connection. Until the address counter value ADR is received (when the determination in S240 is NO), execution of S250 is put on hold. For example, in the example of FIG. 5, in a case where no communication failure has occurred, since the reception ADR-6 in S250, the number of connected suppliers is recognized to be six.

FIG. 8 shows a flowchart illustrating control processing by the controller of the middle follower hot water supplier. The control processing shown in FIG. 8 is executed after S140, for example, by the controller of the hot water supplier that has recognized in S140 that itself is a middle follower hot water supplier.

As shown in FIG. 8, the controller 110 of the middle follower hot water supplier determines in S310 whether or not the second communication unit 112 has received the address counter value ADR from the adjacent hot water supplier on the upstream side, if received (when the determination in S310 is YES), it counts up (+1) the received address counter value ADR (reception ADR) in S320 so as to generate the address counter value ADR (transmission ADR) to transmit to the adjacent hot water supplier on the downstream side.

In S330, the controller 110 of the middle follower hot water supplier recognizes the address counter value ADR (transmission ADR) counted up in S320 as address of its own device. As a result, the address of the middle follower hot water supplier becomes a value sequentially counted up from "#02" onwards. Then, in S340, the controller 110 of the middle follower hot water supplier transmits the transmission ADR calculated in S320 to the adjacent hot water supplier on the downstream side by the first communication unit 111.

Further, in S350, the controller 110 of the middle follower hot water supplier determines whether or not the first communication unit 111 has received the address counter value ADR from the adjacent hot water supplier on the downstream side, if received (when the determination in S350 is YES), the second communication unit 112 transmits the received address counter value ADR (reception ADR), without change, to the hot water supplier on the upstream side in S360 without counting up. Until the address counter value ADR is received (when the determination in S350 is NO), execution of S360 is put on hold.

As a result, in the example of FIG. 5, the hot water suppliers 100*b* to 100*e* each receive the address counter values ADR=1 to 4 from the upstream side, and transmit the address counter values ADR=2 to 5, to the downstream side, respectively. Further, by transferring the address counter value received from the downstream side without change, it is possible to transfer the transmission ADR without change, from the end follower, which will be described later, corresponding to the number of connected suppliers as described above, to the leader hot water supplier.

FIG. 9 shows a flowchart illustrating control processing by the controller of the end follower hot water supplier. The control processing shown in FIG. 9 is executed after S150, for example, by the controller of the hot water supplier that has recognized in S150 that itself is an end follower hot water supplier.

As shown in FIG. 9, the controller 110 of the end follower hot water supplier executes S310 to S330 similar to those in FIG. 8, counts up (+1) the reception ADR from the adjacent hot water supplier on the upstream side, and calculates the transmission ADR (S320). Further, the controller 110 of the end follower hot water supplier recognizes the transmission ADR after counting up as address of its own device. As a result, the address of the end follower hot water supplier becomes a value counted up for each hot water supplier, that is, a value equivalent to the number of connected suppliers in a daisy-chained communication connection (S330).

In S335, the controller 110 of the end follower hot water supplier transmits the transmission ADR calculated in step S330 to the hot water supplier on the upstream side by the second communication unit 112. The transmission address from the end follower hot water supplier, as a value indicating the number of connected suppliers in the daisy-chained communication connection, is transferred without change, without being counted up in each of the middle follower hot water suppliers (S360 in FIG. 8), and is transmitted to the leader hot water supplier (S240 in FIG. 7). As a result, leader hot water suppliers can grasp the number of connected suppliers in the daisy-chained connection, that is, the number of hot water suppliers participating in cooperative control. As a result, the leader hot water supplier may manage cooperative control by rotating the roles of the main 1 hot water supplier, the main 2 hot water supplier, and four sub hot water suppliers with respect to the hot water suppliers having addresses "#01" to "#06".

As described above, in the hot water supply system according to the embodiment, by executing the control processing of FIGS. 6 to 9 when the power supply is turned on after the connection through the communication lines 9, in the initial state, for example, in the structural example of FIG. 1 where communication failure does not occur, it is possible to automatically decide the leader hot water supplier that manages cooperative control without inputting data to distinguish between hot water suppliers. Further, the leader hot water supplier may automatically obtain the number of hot water suppliers participating in cooperative control (the number of connected suppliers), and the processing of assigning an address to each hot water supplier and allowing each hot water supplier to recognize address of its own device may also be automatically executed.

Moreover, each of the hot water suppliers 100*a* to 100*f* may be configured to include a display part 116 such as a segment display of an LED (Light Emitting Diode). In this case, the display part 116 may display address of its own device recognized by each hot water supplier as its own for a certain period of time in response to the above-described transmission and reception of the address counter value. Thereby, workers and the like can easily confirm whether or not the address has been correctly assigned under the automatic decision scheme for role allocation.

Further, by periodically repeating the processing shown in FIGS. 7 to 9, it is possible to re-decide the role allocation of cooperative control in response to a case where the daisy-chained mode changes due to occurrence of a communication failure.

Figure 10:
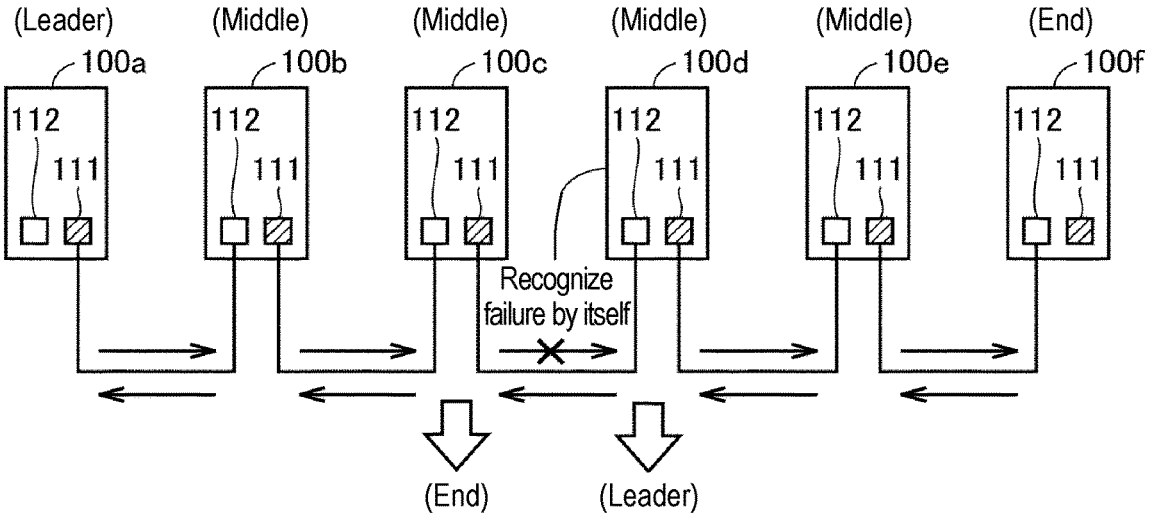
FIG. 10 is a conceptual diagram illustrating a first example of occurrence of communication failure in a hot water supply system according to an embodiment.
Figure 11:
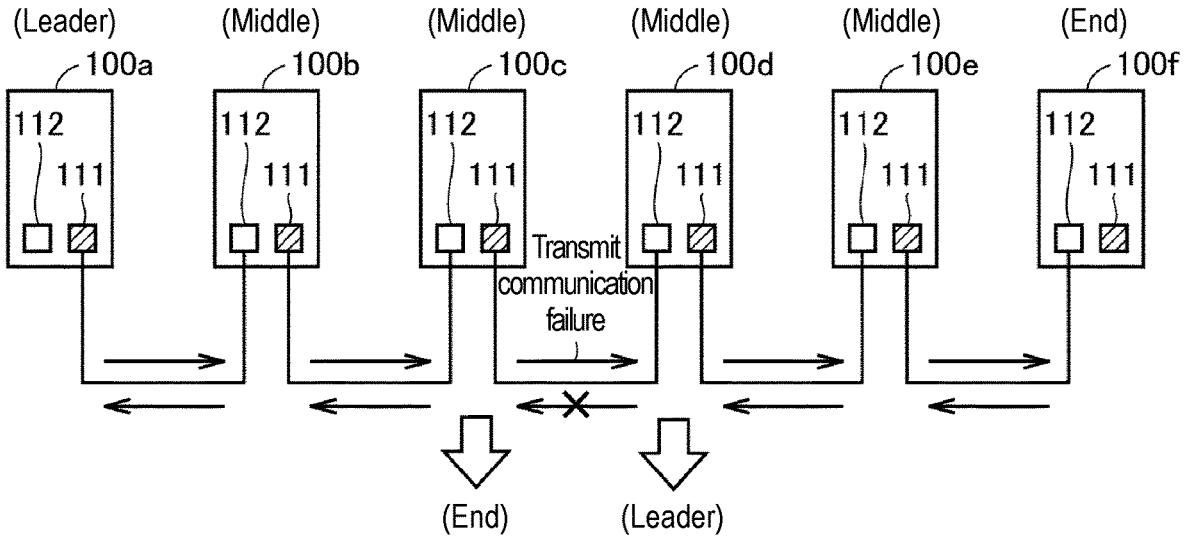
FIG. 11 is a conceptual diagram illustrating a second example of occurrence of communication failure in a hot water supply system according to an embodiment.

FIGS. 10 and 11 show an example of occurrence of communication failure in the hot water supply system according to the embodiment.

The first example of occurrence in FIG. 10 shows an example in which transmission failure from the upstream side to the downstream side from the hot water supplier 100*c* to the hot water supplier 100*d* fails. In this case, the second communication unit 112 of the hot water supplier 100*d* on the receiving side (downstream side) may recognize the communication failure. As a result, if the control processing of FIG. 6 is executed in the hot water supplier 100*d*, the determination in S110 is NO, so the hot water supplier 100*d* is recognized as a new leader hot water supplier. On the other hand, in the hot water suppliers 100*e* and 100*f*, the state of communication with the adjacent hot water suppliers through the first communication unit 111 and the second communication unit 112 is unchanged. Thus, in the hot water suppliers 100*e* and 100*f*, the roles of the "middle follower hot water supplier" and the "end follower hot water supplier" are unchanged.

Moreover, the hot water supplier 100*c* on the transmitting side (upstream side), upon receiving information from the hot water supplier 100*d* (second communication unit 112) on the receiving side indicating communication failure, may recognize that no communication by the first communication unit 111 is being performed. Thus, if the control processing of FIG. 6 is executed in the hot water supplier 100*c*, the determination in S110 is YES and the determination in S120 is NO, so the hot water supplier 100*c* may be recognized as a new end follower hot water supplier. On the other hand, in the hot water suppliers 100*a* and 100*b*, the state of communication with the adjacent hot water suppliers through the first communication unit 111 and the second communication unit 112 is unchanged. Thus, in the hot water suppliers 100*a* and 100*b*, the roles of the "leader hot water supplier" and the "middle follower hot water supplier" are unchanged.

FIG. 11 shows a second example of occurrence in which transmission from the downstream side to the upstream side from the hot water supplier 100*d* to the hot water supplier 100*c* fails. In this case, the first communication unit 111 of the hot water supplier 100*c* on the receiving side (upstream side) may recognize the communication failure. As a result, if the control processing of FIG. 6 is executed in the hot water supplier 100*c*, the determination in S110 is YES and the determination in S120 is NO, so the hot water supplier

100*c* may be recognized as a new end follower hot water supplier, as in the example of FIG. 10.

On the other hand, the hot water supplier 100*d* on the transmitting side (downstream side), upon receiving information from the hot water supplier 100*c* (first communication unit 111) on the receiving side indicating communication failure, may recognize that no communication by the second communication unit 112 is being performed. As a result, if the control processing of FIG. 6 is executed in the hot water supplier 100*d*, the determination in S110 is NO, so the hot water supplier 100*d* may be recognized as a leader hot water supplier, as in the example of FIG. 10.

Moreover, in the example of FIG. 11, in the hot water suppliers 100*a*, 100*c*, 100*e*, and 100*f*, the state of communication with the adjacent hot water suppliers by the first communication unit 111 and the second communication unit 112 is unchanged. Thus, the role allocation among these hot water suppliers remains the same as before the communication failure occurred.

Moreover, in a case where a communication failure occurs due to disconnection of the communication line 9, in response to the detection of signal interruption from the upstream side or the downstream side continuously for a certain period of time, it may be determined that no communication is being performed in the first communication unit 111 or the second communication unit 112 (S110, S120 of FIG. 6).

Figure 12:
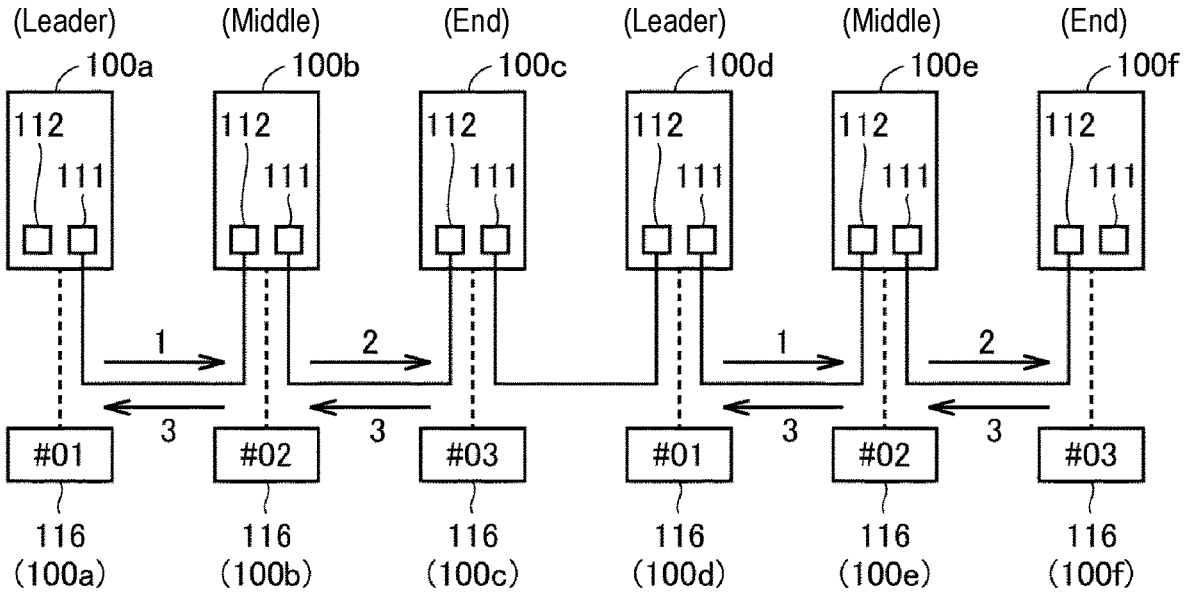
FIG. 12 is a conceptual diagram illustrating a control processing based on role allocation that is reset after a communication failure illustrated in FIG. 10 or 11 occurs in the hot water supply system according to an embodiment.

FIG. 12 shows a conceptual diagram illustrating a control processing based on role allocation reset after the communication failure illustrated in FIG. 10 or 11 occurs.

In response to occurrence of communication failure between the hot water suppliers 100*c* and 100*d* illustrated in FIG. 10 or 11, after the role allocation of the hot water suppliers 100*c* and 100*d* are changed, one of the control processing shown in FIGS. 7 to 9 is executed in each of the hot water suppliers 100*a* to 100*f*.

As a result, as shown in FIG. 12, the address counter value ADR (ADR=1) set to the initial value is transmitted from the hot water suppliers 100*a* and 100*d*, which are the leader hot water suppliers, to the hot water suppliers 100*b* and 100*e* on the downstream side (S210 and S220 in FIG. 7). The hot water suppliers 100*b* and 100*e*, which are middle follower hot water suppliers, recognize addresses of their own devices as "#02" based on the transmission ADR that is counted up from the reception ADR (=1) (S310 to S330 in FIG. 8), and transmit the transmission ADR (=2) to the hot water suppliers 100*c* and 100*f* on the downstream side (S340 in FIG. 8).

The hot water suppliers 100*c* and 100*e*, which are end follower hot water suppliers, recognize addresses of their own devices as "#03" based on the transmission ADR that is counted up from the reception ADR (=2) (S310 to S330 in FIG. 9), and transmit the transmission ADR (=3) to the hot water suppliers 100*b* and 100*e* on the upstream side (S335 in FIG. 9). The transmission ADR from the hot water suppliers 100*b* and 100*e* (end follower hot water suppliers) is transferred by the hot water suppliers 100*b* and 100*e*, and transmitted to the hot water suppliers 100*a* and 100*d*, which are leader hot water suppliers.

As a result, in the hot water supply system according to the embodiment, cooperative control may be managed by a leader hot water supplier (hot water suppliers 100*a* and 100*d*) that recognizes that the number of connected suppliers is 3 in each of the group of hot water suppliers 100*a* to 100*c* and the group of the hot water suppliers 100*d* to 100*f*, where communication is cut off due to communication failure between hot water supplier 100*c* and the hot water supplier 100*d*.

Thereby, it is possible to ensure the hot water supply flow rate of the hot water supply system 10 by the hot water supply capacities of the total of six hot water suppliers 100*a* to 100*f*. In this way, by periodically executing the control processing shown in FIGS. 6 to 9, when a communication failure occurs, it is possible to automatically reset the role allocation of cooperative control in each of the groups where communication has been interrupted. Thereby, it is possible to avoid a decrease in the number of hot water suppliers capable of supplying hot water under cooperative control before and after a communication failure occurs.

Further, by configuring the display unit 116 to display address of its own device recognized by each hot water supplier for a certain period of time, even when the role allocation is automatically reset after a communication failure occurs, it is possible to easily confirm that cooperative control is executed normally by correctly assigning addresses.

In the embodiment, the controller 110 installed on the "end follower hot water supplier" corresponds to an example of the "end follower controller" and the controller 110 installed on the "middle follower hot water supplier" corresponds to an example of the "middle follower controller". Further, the control processing shown in FIG. 6 corresponds to an example of the "first control processing", and the control processing shown in FIGS. 7 to 9 corresponds to an example of the "second control processing".

Moreover, in the embodiment, an example in which after being initialized in the leader hot water supplier, an address counter value that changes each time by a specified value (for example, counted up each time by 1) is sequentially transmitted to the middle follower hot water supplier and the end follower hot water supplier in turn, and the value is then transferred without change to the leader hot water supplier after the end follower hot water supplier counts up, but instead of such a "counter value", the same effect can be achieved by a mode in which arbitrary data is sequentially changed according to a predetermined rule, and sequentially transmitted to the middle follower hot water suppliers and the end follower hot water supplier, that is, assigning address to each hot water supplier and obtaining the number of connected suppliers in the daisy-chained connection.

Example of Modification

In FIGS. 1 to 12, an example has been described in which a hot water supply system is configured by hot water suppliers that are capable of communication connection with two different hot water suppliers by each hot water supplier being equipped with two communication units. In such a configuration, the number of hot water suppliers that make up the hot water supply system can be flexibly changed by the daisy-chained connection. Thereby, the degree of freedom in the range of hot water supply flow rate that may be handled may be improved.

Figure 13:
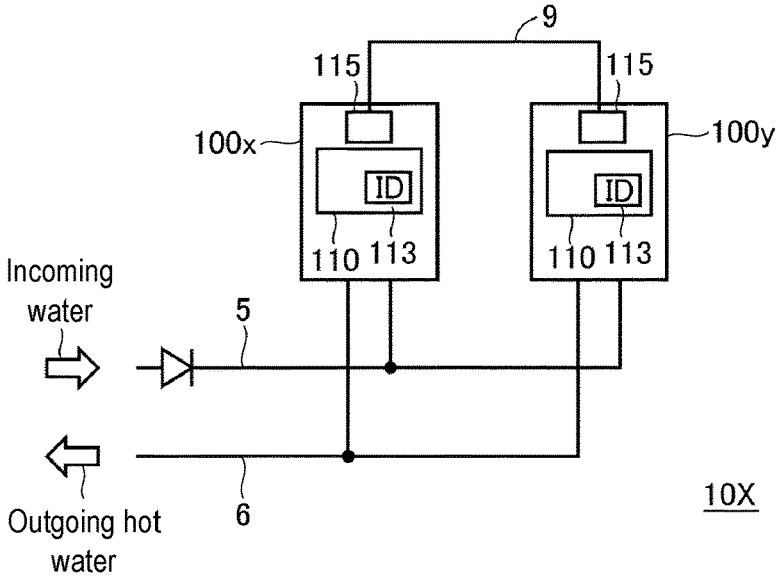
FIG. 13 is a conceptual diagram illustrating a configuration example of a hot water supply system according to an example of modification of the embodiment.
Figure 14:
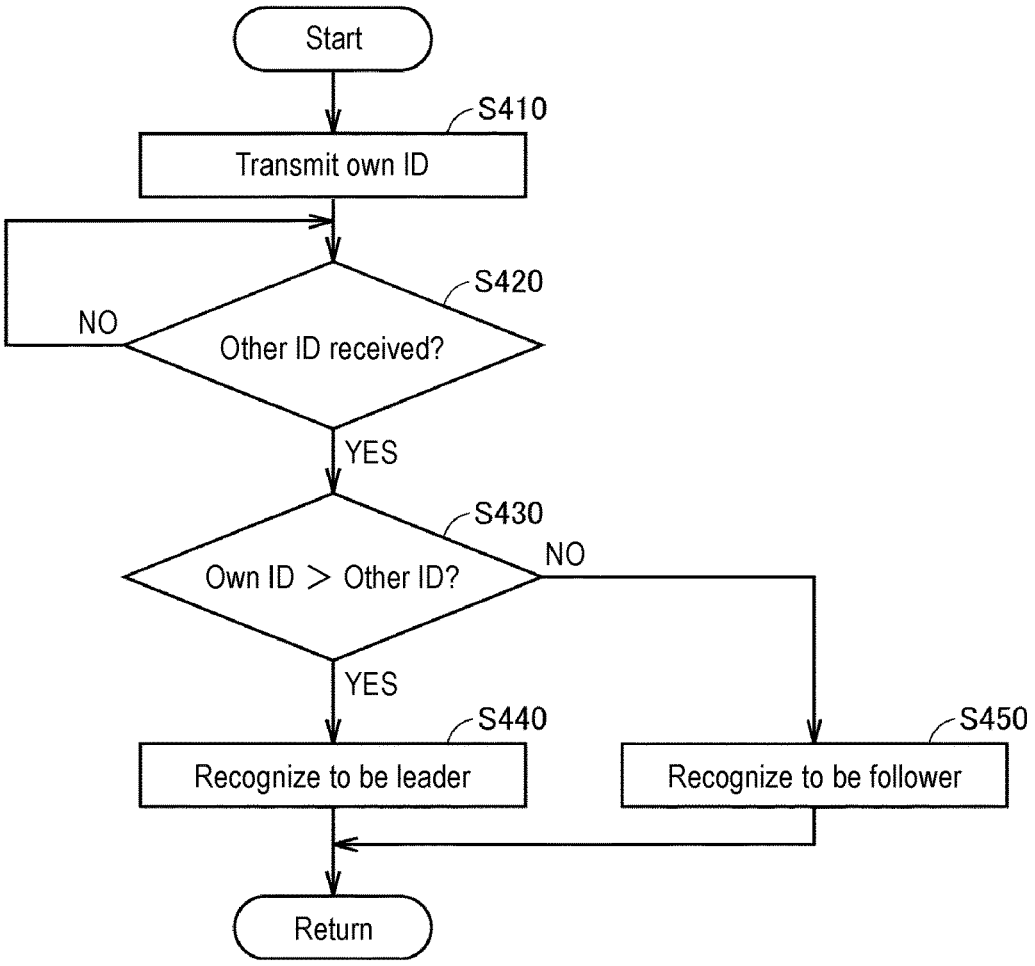
FIG. 14 is a flowchart illustrating a control processing for deciding role allocation of cooperative control in the hot water supply system shown in FIG. 13.

In FIGS. 13 and 14, cooperative control in a hot water supply system (for example, for home use) in which the number of hot water suppliers is limited to two will be described as an example of modification.

FIG. 13 is a conceptual diagram illustrating a configuration example of a hot water supply system 10X according to an example of modification of the embodiment.

Referring to FIG. 13, the hot water supply system 10X includes the water inlet route 5, the hot water outlet route 6, and two hot water suppliers 100$x$ and 100$y$ connected in parallel to the hot water outlet route 6. Each of the hot water suppliers 100$x$, 100$y$ includes a single communication unit 115, so it may communicate with only one hot water supplier. Thus, by configuring the communication unit 115 of the hot water suppliers 100$x$ and 100$y$ to be connected with the communication line 9 such that data is transmitted and received between the hot water suppliers 100$x$ and 100$y$, the hot water supply system 10X composed of two hot water suppliers is configured.

In the hot water supply system 10X, by designating one of the hot water suppliers 100$x$ and 100$y$ as a main hot water supplier, which is in the water flow mode during hot water supply standby, and designating the other of the hot water suppliers 100$x$ and 100$y$ as a sub hot water supplier in the standby mode during the hot water supply standby, the cooperative control of two hot water suppliers may be executed.

In cooperative control with two hot water suppliers, it is also necessary to perform rotation similar to that shown in FIG. 4 such that the cumulative values of operating time (combustion time) are balanced between the hot water suppliers 100$x$ and 100$y$. For this reason, it is necessary to decide the role allocation such that one of the hot water suppliers 100$x$ and 100$y$ is the above-mentioned leader hot water supplier.

In the example of modification shown in FIG. 13, an ID assigned to each hot water supplier at the time of shipment from factories is stored in a memory 113 of the controller 110. Each ID is made up of only numbers or a combination of letters and numbers, and is assigned such that comparisons may be made according to predetermined rules.

FIG. 14 is a flowchart illustrating a control processing for deciding role allocation of cooperative control in the hot water supply system 10X. The control processing shown in FIG. 14 may be executed by each controller 110 of the hot water suppliers 100$x$ and 100$y$ when the power is turned on.

As shown in FIG. 14, in S410, the controller 110 transmits the ID of its own device (own ID) stored in the memory 113 to other hot water suppliers connected through the communication line 9 via the communication unit 115. Then, in S420, the controller 110 confirms whether or not an ID (another ID) transmitted from another hot water supplier is transmitted. When the other ID is received (when the determination in S420 is YES), in S430, the controller 110 compares its own ID stored in the memory 113 with the received other ID.

In a case where the controller 110 determines that its own ID is larger than other IDs (when the determination in S430 is YES) according to the predetermined rules, it recognizes that its own device is a leader hot water supplier in S440. On the other hand, if it determines that the other ID is larger than its own ID (when the determination in S430 is NO), it recognized its own device as a "follower hot water supplier" in S450.

As a result, in the hot water supply system 10X of the comparative example, it is also possible to decide the role allocation in which one of the hot water suppliers communicatively connected is the leader hot water supplier, and to achieve efficient hot water supply through cooperative control of the two hot water suppliers.

Moreover, since the hot water supply system 10X includes two hot water suppliers, if a communication failure occurs, cooperative control becomes impossible, and the hot water suppliers 100$x$ and 100$y$ operate independently to supply hot water to the hot water outlet route 6. Thus, the control processing in FIG. 14 does not need to be executed periodically after deciding the leader hot water supplier when the power is turned on.

The embodiments disclosed this time should be considered to be illustrative in all respects and not restrictive. The scope of the disclosure is indicated by the claims rather than the above description, and it is intended that all changes within the scope and meanings equivalent to the claims are included.

What is claimed is:

1. A hot water supply system, comprising:

a plurality of hot water suppliers connected in parallel to a common hot water outlet route, wherein each of the plurality of hot water suppliers comprises:

a first communication unit and a second communication unit connectable to different communication lines; and a controller that controls an operation of the hot water supplier, wherein the controller of each of the hot water suppliers is configured in advance to have a supervisory control function for cooperatively operating a group of hot water suppliers communicatively connected in series via the communication lines, and between adjacent hot water suppliers in a series connection constituting the communication connection, the first communication unit of a hot water supplier on an upstream side, which is one predetermined end side of the series connection, and the second communication unit of a hot water supplier on a downstream side, which is the other end side of the series connection, in the group of hot water suppliers are communicatively connected sequentially, wherein each of the controllers is configured to execute:

a first control processing that recognizes, based on presence or absence of communication by the first communication unit and the second communication unit, whether the controller is a leader controller installed on a leader hot water supplier positioned at a most upstream of the series connection in the group of hot water suppliers and operating to execute the supervisory control; an end follower controller installed on an end follower hot water supplier positioned at a most downstream of the series connection in the group of hot water suppliers; or a middle follower controller installed on a hot water supplier communicatively connected between the leader hot water supplier and the end follower hot water supplier, and a second control processing that transmits data initialized by the leader controller to the end follower controller while changing it according to a predetermined rule by each of the middle follower controllers, and transfers the data further changed by the end follower controller according to the rule, with content unchanged, to the leader controller by each of the middle follower controllers, wherein the data is a counter value that, after being initialized by the leader controller, is changed each time by a specified value by the middle follower controllers and transmitted to the end follower controller, and after being further changed by the specified value by the end follower controller, is transferred, with the value unchanged, to the leader controller by each of the middle follower controllers, and the leader controller recognizes, based on an initial value of the counter value, an address of the hot water supplier on which the controller is installed, the end follower controller and each of the middle follower controllers recognize, based on the counter value after being changed each time by the specified value, an address of the hot water supplier on which the controller is installed, and each of the hot water suppliers further comprises a display part for displaying the address recognized by each of the controllers.

2. The hot water supply system according to claim 1, wherein the leader controller obtains a number of the hot water suppliers in a group of hot water suppliers based on the counter value transferred from the end follower controller, and executes the supervisory control.

3. The hot water supply system according to claim 2, wherein each of the controllers repeatedly executes the first control processing and the second control processing while the hot water supply system is in operation.

4. The hot water supply system according to claim 1, wherein the supervisory control comprises a rotation processing in the group of hot water suppliers of designating an operation start order in response to an increase in a hot water supply flow rate.

5. The hot water supply system according to claim 2, wherein the supervisory control comprises a rotation processing in the group of hot water suppliers of designating an operation start order in response to an increase in a hot water supply flow rate.

6. The hot water supply system according to claim 1, wherein each of the controllers repeatedly executes the first control processing and the second control processing while the hot water supply system is in operation.

* * * * *